US008936083B2

(12) United States Patent
Nguyen

(10) Patent No.: US 8,936,083 B2
(45) Date of Patent: Jan. 20, 2015

(54) METHODS OF FORMING PILLARS AND CHANNELS IN PROPPED FRACTURES

(75) Inventor: Philip D. Nguyen, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 277 days.

(21) Appl. No.: 13/596,662

(22) Filed: Aug. 28, 2012

(65) Prior Publication Data

US 2014/0060826 A1 Mar. 6, 2014

(51) Int. Cl.
*E21B 43/267* (2006.01)

(52) U.S. Cl.
USPC ..... 166/278; 166/280.1; 166/281; 166/308.1; 166/308.5

(58) Field of Classification Search
CPC ..... E21B 43/267
USPC ..... 166/278, 280.2, 283, 280.1, 281, 308.1, 166/308.2, 308.3, 308.5, 308.6
See application file for complete search history.

(56) References Cited

U.S. PATENT DOCUMENTS 4,585,064 A 4/1986 Graham et al.
4,887,670 A * 12/1989 Lord et al. ..... 166/281
4,969,523 A 11/1990 Martin et al.
5,159,979 A * 11/1992 Jennings, Jr. ..... 166/308.2
5,249,627 A 10/1993 Harms et al.
5,833,000 A 11/1998 Weaver et al.
5,839,510 A 11/1998 Weaver et al.
5,853,048 A 12/1998 Weaver et al.
6,287,639 B1 9/2001 Schmidt et al.
6,311,773 B1 11/2001 Todd et al.
6,439,309 B1 8/2002 Matherly et al.
6,582,819 B2 6/2003 McDaniel et al.
6,677,426 B2 1/2004 Noro et al.
7,153,575 B2 12/2006 Anderson et al.
7,281,581 B2 10/2007 Nguyen et al.
7,281,590 B2 10/2007 van de Waal
7,392,847 B2 7/2008 Gatlin et al.
7,673,686 B2 3/2010 Nguyen et al.
7,825,074 B2 11/2010 Schmidt et al.
7,956,017 B2 6/2011 Gatlin et al.
8,003,579 B2 8/2011 Akarsu et al.
8,066,068 B2 11/2011 Lesko et al.
2005/0274517 A1 12/2005 Blauch et al.
2005/0277554 A1 12/2005 Blauch et al.
2006/0113078 A1 6/2006 Nguyen et al.
2007/0131422 A1 6/2007 Gatlin et al.
2007/0131425 A1 6/2007 Gatlin et al.
2007/0289781 A1 12/2007 Rickman et al.
2008/0006405 A1 1/2008 Rickman et al.
2010/0160187 A1 6/2010 Nguyen et al.

(Continued)

*Primary Examiner* — Zakiya W Bates
*Assistant Examiner* — Silvana Runyan
(74) *Attorney, Agent, or Firm* — McDermott Will & Emery LLP; Craig W. Roddy

(57) ABSTRACT

Methods of forming channels within propped fractures that are essentially free of proppants and more spacious than the interstitial spaces within traditional proppant packs. Specifically, various proppant-laden fluids may be placed within a fracture in a subterranean formation, the proppants in the proppant-laden fluids having at least two distinct ranges of density. Once placed inside the fracture, the proppants can settle, separate, and consolidate into at least two distinct permeable masses according to their densities. Consequently, the high-density and low-density proppants can separate and form separate proppant masses when the fracture closes on the proppants. Through this process, a highly conductive channel can form inside the fracture through which production fluids can flow.

20 Claims, 1 Drawing Sheet

(56) References Cited

U.S. PATENT DOCUMENTS

2011/0030950 A1 2/2011 Weaver et al.
2011/0039737 A1 2/2011 Schmidt et al.
2011/0067868 A1 3/2011 Le Roy-Delage et al.

* cited by examiner

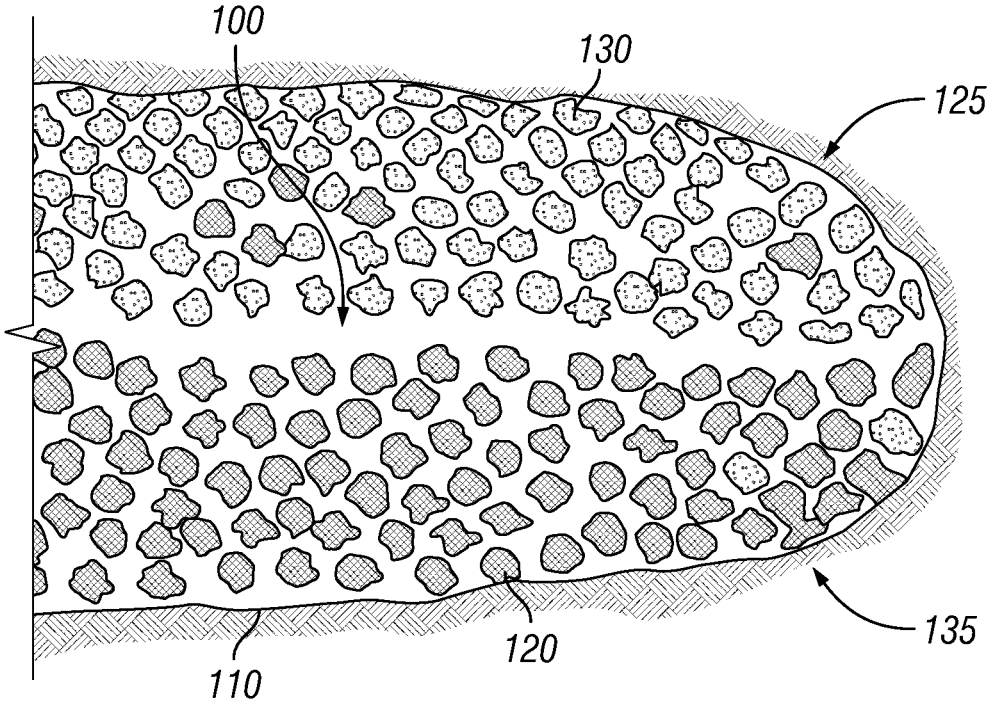
100
130
125
135
120
110

METHODS OF FORMING PILLARS AND CHANNELS IN PROPPED FRACTURES

BACKGROUND

The present invention relates to fracturing operations and, more particularly to, methods of forming highly conductive pillars and channels in propped fractures.

Various methods are known for fracturing a subterranean formation to enhance the production of fluids. In a hydraulic fracturing operation, a pressurized fracturing fluid can be used to hydraulically create and propagate a fracture within the subterranean formation. Fracturing fluids can also carry and deposit solids such as proppants into the fracture. Inside the fracture, the proppants can form a tightly packed permeable mass (sometimes referred to as a "proppant pack"). The proppant pack serves as a physical barrier that prevents the fracture from fully closing and as a conduit through which production fluids can flow. The degree of success of a fracturing operation depends, at least in part, upon the fracture conductivity once the fracturing operation is stopped and production is begun. The conductivity of these proppant packs are somewhat limited because of the relatively small interconnected interstitial spaces between the packed proppant.

Another fracturing approach involves placing a much reduced volume of proppants in a fracture in order to create a high porosity fracture. In such operations, the proppant particulates within the fracture may be widely spaced but still present in an amount sufficient to hold the fracture open and allow for production fluids to flow. An increased fracture conductivity may result due to the fact that the produced fluids may flow around widely spaced proppant rather than through the relatively small interstitial spaces in a proppant pack. While this fracturing concept has been investigated in the industry, its widespread usefulness is still somewhat limited for a number of reasons. Among other things, settling of proppant can be particularly problematic when fracturing with a reduced volumes of proppants are used. Proppant settling may lead to a fracture or a top portion of a fracture closing, which can lower the conductivity of the propped fracture and result in proppant aggregation, rather than discrete proppant pillars.

SUMMARY OF THE INVENTION

The present invention relates to fracturing operations and, more particularly to, methods of forming highly conductive pillars and channels in propped fractures.

In some embodiments, the present invention provides a method comprising: a) introducing high-density proppants into a fracture within a subterranean formation, wherein the fracture has a lower portion and an upper portion; b) introducing a spacer gel into the fracture; c) introducing low-density proppants into the fracture; d) repeating any sequence of a), b), and c) until a predetermined amount of high-density proppants, spacer gel, and low-density proppants has been introduced into the fracture; e) allowing the high-density proppants to migrate to the lower portion of the fracture and form a high-density proppant pack; and f) allowing the low-density proppants to migrate to the upper portion of the fracture and form a low-density proppant pack.

In other embodiments, the present invention provides a method comprising: a) introducing a high-density slurry comprising high-density proppants and degradable spacer particulates into a fracture within a subterranean formation, wherein the fracture has a lower portion and an upper portion; b) introducing a spacer gel into the fracture; c) introducing a low-density slurry comprising low-density proppants and degradable spacer particulates; d) repeating any sequence of a), b), and c) until a predetermined amount of high-density slurry, spacer gel, and low-density slurry has been introduced into the fracture; e) allowing the high-density slurry to migrate to the lower portion of the fracture and form a high-density proppant pack; and f) allowing the low-density slurry to migrate to the upper portion of the fracture and form a low-density proppant pack.

In still other embodiments, the present invention provides a method comprising: a) introducing a mixture of a high-density slurry comprising high-density proppants and degradable spacer particulates and a low-density slurry comprising low-density proppants and degradable spacer particulates into a fracture within a subterranean formation, wherein the fracture has a lower portion and an upper portion; b) introducing a spacer gel into the fracture; c) repeating any sequence of a) and b) until a predetermined amount of the mixture of high-density slurry and low-density slurry and spacer gel has been introduced into the fracture; d) allowing the high-density slurry to migrate to the lower portion of the fracture and form a high-density proppant pack; and e) allowing the low-density slurry to migrate to the upper portion of the fracture and form a high-density proppant pack.

The features and advantages of the present invention will be readily apparent to those skilled in the art upon a reading of the description of the preferred embodiments that follows.

BRIEF DESCRIPTION OF THE DRAWINGS

The following figures are included to illustrate certain aspects of the present invention, and should not be viewed as exclusive embodiments. The subject matter disclosed is capable of considerable modifications, alterations, combinations, and equivalents in form and function, as will occur to those skilled in the art and having the benefit of this disclosure.

FIG. 1 is a schematic illustration of a propped fracture featuring a channel according to one or more embodiments.

DETAILED DESCRIPTION

The present invention relates to fracturing operations and, more particularly to, methods of forming highly conductive pillars and channels in propped fractures.

The present invention provides methods of forming channels within propped fractures. The channels are essentially free of proppants ("proppant free") and more spacious than the interstitial spaces within proppant packs. Consequently, propped fractures featuring proppant-free channels should be highly conductive, particularly when compared to conventional propped fractures.

In certain methods of the present invention, various proppant-laden fluids may be placed within a fracture in a subterranean formation. The proppants may have at least two distinct ranges of density (e.g., low-density proppants and high-density proppants). Additional proppants having other density values may be used without departing from the scope of the present invention. While at least one embodiment described herein relates to the formation of proppant masses, it is understood that other consolidated proppant forms (e.g., proppant pillars) may be compatible with the present invention.

Once placed inside the fracture, the proppants can settle, separate, and consolidate into at least two distinct permeable masses according to their densities. For example, the high-density proppants may have a tendency to settle to the bottom portion of the fracture since their densities can be greater than the density of the carrier fluid. On the other hand, the low-density proppants may resist the tendency to settle since their densities can be less than the density of the carrier fluid. Consequently, the high-density and low-density proppants can separate and form separate proppant masses when the fracture closes on the proppants. Through this process, a highly conductive channel can form inside the fracture through which production fluids can flow. As used herein, the term "highly conductive channel" refers to a channel having a conductivity substantially similar to that of a proppant-free channel.

FIG. 1 shows a schematic illustration of a highly conductive channel 100 formed within fracture 110. As shown, the channel 100 is proppant-free and should allow relatively unimpeded flow of fluids therethrough. The fracture 110 also features two distinct permeable masses (125, 135) through which fluids can flow. Permeable mass 135 comprises mostly high-density proppants 120 that have settled to the lower portion of the fracture 110. The top-most proppant layer of permeable mass 135 defines the bottom face of channel 100. Permeable mass 125 comprises mostly low-density proppants 130 that have separated from the high-density proppants and consolidated in the upper portion of the fracture 110. The bottom-most proppant layer of permeable mass 125 defines the top face of channel 100. Whenever terms such as "lower" or "upper" are used to describe the orientation of a fracture, "lower" typically refers to the portion of the fracture that high-density proppants generally settle towards while "upper" may be determined by its orientation in relation to the above-defined "bottom".

While at least some embodiments described herein relate to methods of using proppants having two ranges of density (i.e., low-density proppants and high-density proppants), this is not intended to be limiting. For example, additional proppants (e.g., super high-density proppants or super low-density proppants) may be provided according to one or more embodiments of the present invention. Moreover, the proppants may be introduced into the fracture in any number of ways. In some embodiments, the present invention may provide a single proppant-laden fluid comprising a mixture of both low-density proppants and high-density proppants. In other embodiments, multiple proppant-laden fluids (e.g., a proppant-laden fluid comprising only or mostly high-density proppants) may be used wherein each proppant-laden fluid is introduced separately into the fracture.

According to some embodiments of the present invention, a fracture may be created and/or extended by any suitable means. Such means are well-known to those skilled in the relevant art. For example, in some embodiments, a pre-pad or pad fluid may be injected to initiate the fracturing of a subterranean formation prior to the injection of proppants (i.e., high-density proppants and low-density proppants). In such embodiments, the pre-pad or pad fluid may be proppant-free or substantially proppant-free. In other embodiments, the proppants may be suspended in a slurry which may be injected into the subterranean formation to create and/or extend at least one fracture. In order to create and/or extend a fracture, a fluid is typically injected into the subterranean formation at a rate sufficient to generate a pressure above the fracture gradient.

Traditional fracturing operations can involve packing relatively high volumes of proppants within a fracture. In such operations, a single homogeneous proppant pack is typically formed, which may be used to abut the fracture so that production fluids can be recovered through to the relatively small interstitial spaces between the tightly packed proppants.

The present invention discloses that placing proppants of varying densities into a fracture can lead to formation of distinct permeable proppant masses which can define a conductive channel. In some embodiments, a mixture of low-density proppants, high-density proppants, and a carrier fluid may be introduced into the fracture. In other embodiments, a proppant-laden fluid comprising mostly high-density proppants may be first introduced into the fracture and a proppant-laden fluid comprising mostly low-density proppants may be subsequently introduced. It should be understood that when high-density and low-density proppants are introduced separately, the exact sequence of their introduction may not be important. For example, the proppant-laden fluid comprising low-density proppants may be introduced prior to the introduction of the proppant-laden fluid comprising high-density proppants, or vice versa. Moreover, the sequence of introducing the various proppant-laden fluids may be repeated and/or varied as necessary. In some embodiments, the proppants may be added until a selected amount of the high-density proppant and/or low-density proppant has been placed within the fracture. In other embodiments, a spacer gel may also be introduced. In those embodiments, the sequence of introducing the spacer gel relative to the low-density proppants and high-density proppants may not be important.

The proppants may be placed within a fracture by any number of ways. In some embodiments, proppants may be suspended in a carrier fluid which may then be used to transport the proppants to the fracture. It may be desirable that the carrier fluid has a specific gravity that falls between the specific gravity of the high-density proppants and the low-density proppants. The exact specific gravity value may not be important as long as the high-density proppants and the low-density proppants sufficiently separate in the carrier fluid when placed in a fracture. In some embodiments, the specific gravity of the carrier fluid ranges from about 0.75 $g/cm^3$ to about 1.25 $g/cm^3$. In some embodiments, the specific gravity of the carrier fluid ranges from about 0.85 $g/cm^3$ to about 1.15 $g/cm^3$. In some embodiments, the specific gravity of the carrier fluid ranges from about 0.95 $g/cm^3$ to about 1.10 $g/cm^3$.

Any suitable carrier fluid that may be employed in subterranean operations may be used in accordance with the present invention, including aqueous gels, viscoelastic surfactant gels, oil gels, foamed gels, and emulsions. Suitable aqueous gels are generally comprised of water and one or more gelling agents. Suitable emulsions can be comprised of two immiscible liquids such as an aqueous liquid or gelled liquid and a hydrocarbon. Foams can be created by the addition of a gas, such as carbon dioxide or nitrogen. In some embodiments of the present invention, the carrier fluids are aqueous gels comprised of water, a gelling agent for gelling the water and increasing its viscosity, and, optionally, a crosslinking agent for crosslinking the gel and further increasing the viscosity of the fluid. The increased viscosity of the gelled, or gelled and cross-linked, carrier fluid, inter alia, reduces fluid loss and allows the carrier fluid to transport proppants. The water used to form the carrier fluid may be fresh water, saltwater, seawater, brine, or any other aqueous liquid that does not adversely react with the other components.

Proppants suitable for use in the methods of the present invention may be of any size and shape combination known in the art as suitable for use in a fracturing operation. Generally, where the chosen proppant is substantially spherical, suitable proppant particulates have a size in the range of from about 2 to about 400 mesh, U.S. Sieve Series. In some embodiments of the present invention, the proppant particulates have a size in the range of from about 20 to about 180 mesh, U.S. Sieve Series.

The present invention provides low-density proppants and high-density proppants. As used herein, the term "low-density proppants" generally refers to proppants having an average density of about 0.95 g/cm$^3$ or less. In some embodiments, the average density of low-density proppants is 0.85 g/cm$^3$ or less. In some embodiments, the average density of low-density proppants is 0.75 g/cm$^3$ or less. As used herein, the term "high-density proppants" generally refers to proppants having an average density of about 1.10 g/cm$^3$ or greater. In some embodiments, the average density of high-density proppants is 1.20 g/cm$^3$ or greater. In some embodiments, the average density of high-density proppants is 2.6 g/cm$^3$ or greater. The exact value of average density may depend on a number of factors including, but not limited to, the carrier fluid used, the number of different proppants used, and the like. In some embodiments, the proppant particulates may have a relatively narrow distribution of densities. In other embodiments, the proppant particulates may have a relatively wide distribution of densities.

In some embodiments of the present invention it may be desirable to use substantially non-spherical proppant particulates. Suitable substantially non-spherical proppant particulates may be cubic, polygonal, fibrous, or any other non-spherical shape. Such substantially non-spherical proppant particulates may be, for example, cubic-shaped, rectangular-shaped, rod-shaped, ellipse-shaped, cone-shaped, pyramid-shaped, or cylinder-shaped. That is, in embodiments wherein the proppant particulates are substantially non-spherical, the aspect ratio of the material may range such that the material is fibrous to such that it is cubic, octagonal, or any other configuration. Substantially non-spherical proppant particulates are generally sized such that the longest axis is from about 0.02 inches to about 0.3 inches in length. In other embodiments, the longest axis is from about 0.05 inches to about 0.2 inches in length. In one embodiment, the substantially non-spherical proppant particulates are cylindrical having an aspect ratio of about 1.5 to 1 and about 0.08 inches in diameter and about 0.12 inches in length. In another embodiment, the substantially non-spherical proppant particulates are cubic having sides about 0.08 inches in length. The use of substantially non-spherical proppant particulates may be desirable in some embodiments of the present invention because, among other things, they may provide a lower rate of settling when slurried into a fluid as is often done to transport proppant particulates to desired locations within subterranean formations.

Proppant particulates suitable for use in the present invention may comprise any material suitable for use in subterranean operations. Suitable materials for these proppant particulates include, but are not limited to, sand, bauxite, ceramic materials, glass materials, polymer materials (such as EVA or composite materials), polytetrafluoroethylene materials, nut shell pieces, cured resinous particulates comprising nut shell pieces, seed shell pieces, cured resinous particulates comprising seed shell pieces, fruit pit pieces, cured resinous particulates comprising fruit pit pieces, wood, composite particulates, and combinations thereof. Suitable composite particulates may comprise a binder and a filler material wherein suitable filler materials include silica, alumina, fumed carbon, carbon black, graphite, mica, titanium dioxide, barite, meta-silicate, calcium silicate, kaolin, talc, zirconia, boron, fly ash, hollow glass microspheres, solid glass, and combinations thereof. Suitable proppant particles for use in conjunction with the present invention may be any known shape of material, including substantially spherical materials, fibrous materials, polygonal materials (such as cubic materials), and combinations thereof.

In some embodiments the proppants of the present invention may be coated with a tackifying agent that may enhance or promote the consolidation of the proppants into a permeable proppant mass. Suitable tackifying agents may include, but are not limited to, non-aqueous tackifying agents, aqueous tackifying agents, silyl-modified polyamide compounds, resins (including curable resin compositions), crosslinkable aqueous polymer compositions, polymerizable organic monomer compositions, consolidating agent emulsions, zeta-potential modifying aggregating compositions, and binders. Combinations and/or derivatives of these also may be suitable. Nonlimiting examples of suitable tackifying agents may be found in U.S. Pat. Nos. 8,003,579, 7,956,017, 7,825,074, 7,673,686, 7,392,847, 7,153,575, 6,677,426, 6,582,819, 6,439,309, 6,311,773, 6,287,639, 5,853,048, 5,839,510, 5,833,000, 5,249,627, and 4,585,064 as well as U.S. Patent Application Publication Nos. 2011/0039737, 2010/0160187, 2011/0030950, 2008/0006405, 2007/0289781, 2007/0131425, 2007/0131422, 2005/0277554, and 2005/0274517, the entire disclosures of the above patents and applications are herein incorporated by reference. It is within the ability of one skilled in the art, with the benefit of this disclosure, to determine the type and amount of tackifying agent to include in the methods of the present invention to achieve the desired results.

The curable resin compositions suitable for use in the present invention may comprise any suitable resin that is capable of forming a hardened, consolidated mass. Many such resins are commonly used in subterranean consolidation operations, and some suitable resins include two-component epoxy-based resins, novolak resins, polyepoxide resins, phenol-aldehyde resins, urea-aldehyde resins, urethane resins, phenolic resins, furan resins, furan/furfuryl alcohol resins, phenolic/latex resins, phenol formaldehyde resins, polyester resins and hybrids and copolymers thereof, polyurethane resins and hybrids and copolymers thereof, acrylate resins, and mixtures thereof. Some suitable resins, such as epoxy resins, may be cured with an internal catalyst or activator so that when pumped downhole, they may be cured using only time and temperature. Other suitable resins, such as furan resins generally require a time-delayed catalyst or an external catalyst to help activate the polymerization of the resins if the cure temperature is low (i.e., less than 250° F.), but will cure under the effect of time and temperature if the formation temperature is above about 250° F., preferably above about 300° F. It is within the ability of one skilled in the art, with the benefit of this disclosure, to select a suitable resin for use in embodiments of the present invention and to determine whether a catalyst is required to trigger curing.

The spacer gel can be introduced into the fracture where it can separate the high-density proppants and the low-density proppants. In some embodiments of the present invention, the spacer gel is itself degradable. Any suitable transport fluid that may be employed in subterranean operations may be used in accordance with the present invention, including aqueous gels, viscoelastic surfactant gels, oil gels, foamed gels, and emulsions. Suitable aqueous gels are generally comprised of water and one or more gelling agents. Suitable emulsions can be comprised of two immiscible liquids such as an aqueous liquid or gelled liquid and a hydrocarbon. Foams can be created by the addition of a foaming agent and a gas, such as carbon dioxide or nitrogen. In some embodiments of the present invention, the spacer gels are aqueous gels comprised of water, a gelling agent for gelling the water and increasing its viscosity, and, optionally, a crosslinking agent for crosslinking the gel and further increasing the viscosity of the fluid. The water used to form the spacer gel may be fresh water, saltwater, seawater, brine, or any other aqueous liquid that does not adversely react with the other components.

Once the degradable spacer gel degrades, a conductive channel can be left behind or otherwise formed within the fracture. In one or more embodiments, the spacer gel may be introduced into the fracture after introducing the high-density proppants and the low-density proppants into the subterranean formation. In other embodiments, the spacer gel may be introduced into the fracture in between the placement of the high-density proppants and the low-density proppants into the subterranean formation. According to at least one embodiment, the spacer gel may be introduced after a time delay, for example, after a period of time during which the high-density proppants and the low-density proppants can settle and separate within the fracture.

In other embodiments, the present invention provides a spacer gel and degradable spacer particulates as part of either a low-density proppant slurry or a high-density proppant slurry. Once the degradable spacer particulates degrade, a conductive channel and/or interstitial spaces between proppants or spacer gel can be left behind or otherwise formed within the fracture. The degradable spacer particulates may also be used as a spacer material to separate or substantially separate low-density proppants and high-density proppants within the fracture.

The degradable spacer particulates may have any shape or form that is compatible with one or more embodiments of the present invention. For example, the degradable spacer particulates may be in the form of a gel body, a solid particulate, and/or a fiber. In some embodiments, the degradable spacer particulates may have a specific gravity that is between the average specific gravity of the high-density proppants and the average specific gravity of the low-density proppants. In some embodiments, the specific gravity of the degradable spacer particulates ranges from about 0.75 g/cm$^3$ to about 1.25 g/cm$^3$. In some embodiments, the specific gravity of the degradable spacer particulates ranges from about 0.85 g/cm$^3$ to about 1.15 g/cm$^3$. In some embodiments, the specific gravity of the degradable spacer particulates ranges from about 0.95 g/cm$^3$ to about 1.10 g/cm$^3$.

Gel bodies suitable for use in the present invention include those described in U.S. Patent Application Publication No. 2010/0089581, the entire disclosure of which is hereby incorporated by reference. In addition, the superabsorbent polymer discussed in U.S. Patent Application Publication No. 2011/0067868, the entire discussion of which is hereby incorporated by reference, may also be suitable for use as gel bodies in the present invention. One of skill in the art will recognize that some of the gel bodies may be designed to degrade once the fracture closes, while other gel bodies may be more resistant to such degradation long after the closing of the fracture.

By way of example, gel bodies of the present invention may be formed from swellable polymers. Preferably, the swellable particulate is an organic material such as a polymer or a salt of a polymeric material. Typical examples of polymeric materials include, but are not limited to, cross-linked polyacrylamide, cross-linked polyacrylate, cross-linked copolymers of acrylamide and acrylate monomers, starch grafted with acrylonitrile and acrylate, cross-linked polymers of two or more of allylsulfonate, 2-acrylamido-2-methyl-1-propanesulfonic acid, 3-allyloxy-2-hydroxy-1-propanesulfonic acid, acrylamide, acrylic acid monomers, and any combination thereof in any proportion. Typical examples of suitable salts of polymeric material include, but are not limited to, salts of carboxyalkyl starch, salts of carboxymethyl starch, salts of carboxymethyl cellulose, salts of cross-linked carboxyalkyl polysaccharide, starch grafted with acrylonitrile and acrylate monomers, and any combination thereof in any proportion. The specific features of the swellable particulate may be chosen or modified to provide a proppant pack or matrix with desired permeability while maintaining adequate propping and filtering capability. These swellable particulates are capable of swelling upon contact with a swelling agent. The swelling agent for the swellable particulate can be any agent that causes the swellable particulate to swell via absorption of the swelling agent. In a preferred embodiment, the swellable particulate is "water swellable," meaning that the swelling agent is water. Suitable sources of water for use as the swelling agent include, but are not limited to, fresh water, brackish water, sea water, brine, and any combination thereof in any proportion. In another embodiment of the invention, the swellable particulate is "oil swellable," meaning that the swelling agent for the swellable particulate is an organic fluid. Examples of organic swelling agents include, but are not limited to, diesel, kerosene, crude oil, and any combination thereof in any proportion. Also by way of example, degradable gel bodies of the present invention may be formed from super-absorbent polymers. Suitable such superabsorbent polymers include polyacrylamide, crosslinked poly(meth) acrylate, and non-soluble acrylic polymers.

Degradable particles suitable for use in the present invention include degradable particles that comprise oil-degradable materials (e.g., oil-degradable polymers). In one or more embodiments, the oil-degradable particles may be degraded by the produced fluids. The degradable particles may also be degraded by materials purposely placed in the formation by injection, mixing the degradable particle with delayed reaction degradation agents, or other suitable means to induce degradation.

Oil-degradable polymers that may be used in accordance with the present invention may be either natural or synthetic polymers. Some particular examples include, but are not limited to, polyacrylics, polyamides, and polyolefins such as polyethylene, polypropylene, polyisobutylene, and polystyrene. Other suitable oil-degradable polymers include those that have a melting point which is such that the polymer will melt or dissolve at the temperature of the subterranean formation in which it is placed such as a wax material.

Other degradable materials that may be used in conjunction with the present invention include, but are not limited to, degradable polymers, dehydrated salts, and/or mixtures of the two. As for degradable polymers, a polymer is considered to be "degradable" herein if the degradation is due to, in situ, a chemical and/or radical process such as hydrolysis, or oxidation. The degradability of a polymer depends at least in part on its backbone structure. For instance, the presence of hydrolyzable and/or oxidizable linkages in the backbone often yields a material that will degrade as described herein. The rates at which such polymers degrade are dependent on the type of repetitive unit, composition, sequence, length, molecular geometry, molecular weight, morphology (e.g., crystallinity, size of spherulites, and orientation), hydrophilicity, hydrophobicity, surface area, and additives. Also, the environment to which the polymer is subjected may affect how it degrades, e.g., temperature, presence of moisture, oxygen, microorganisms, enzymes, pH, and the like.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope and spirit of the present invention. The invention illustratively disclosed herein suitably may be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent or other documents that may be incorporated herein by reference, the definitions that are consistent with this specification should be adopted.

The invention claimed is:

1. A method comprising:

a) introducing high-density proppants into a fracture within a subterranean formation, wherein the fracture has a lower portion and an upper portion;

b) introducing a spacer gel into the fracture;

c) introducing low-density proppants into the fracture;

d) repeating any sequence of a), b), and c) until a predetermined amount of high-density proppants, spacer gel, and low-density proppants has been introduced into the fracture;

e) allowing the high-density proppants to migrate to the lower portion of the fracture and form a high-density proppant pack; and f) allowing the low-density proppants to migrate to the upper portion of the fracture and form a low-density proppant pack, wherein a highly-conductive channel is formed in the fracture between the high-density proppant pack and the low-density proppant pack.

2. The method of claim 1, wherein the high-density proppants have a specific gravity greater than about 1.10 g/cm$^3$.

3. The method of claim 1, wherein the low-density proppants have a specific gravity less than about 0.95 g/cm$^3$.

4. The method of claim 1, wherein the high-density proppants and the low-density proppants are coated with a tackifying agent.

5. The method of claim 1, wherein the spacer gel is degradable.

6. The method of claim 1, wherein the spacer gel further comprises degradable spacer particulates.

7. The method of claim 1, wherein a), b), and c) are performed sequentially.

8. A method comprising:

a) introducing a high-density slurry comprising high-density proppants and degradable spacer particulates into a fracture within a subterranean formation, wherein the fracture has a lower portion and an upper portion;

b) introducing a spacer gel into the fracture;

c) introducing a low-density slurry comprising low-density proppants and degradable spacer particulates;

d) repeating any sequence of a), b), and c) until a predetermined amount of high-density slurry, spacer gel, and low-density slurry has been introduced into the fracture;

e) allowing the high-density slurry to migrate to the lower portion of the fracture and form a high-density proppant pack; and f) allowing the low-density slurry to migrate to the upper portion of the fracture and form a low-density proppant pack, wherein a highly-conductive channel is formed in the fracture between the high-density proppant pack and the low-density proppant pack.

9. The method of claim 8, wherein the high-density proppants have a specific gravity greater than about 1.10 g/cm$^3$.

10. The method of claim 8, wherein the low-density proppants have a specific gravity less than about 0.95 g/cm$^3$.

11. The method of claim 8, wherein the high-density proppants and the low-density proppants are coated with a tackifying agent.

12. The method of claim 8, wherein the spacer gel is degradable.

13. The method of claim 8, wherein the spacer gel further comprises degradable spacer particulates.

14. The method of claim 8, wherein a), b), and c) are performed sequentially.

15. A method comprising:

a) introducing a mixture of a high-density slurry comprising high-density proppants and degradable spacer particulates and a low-density slurry comprising low-density proppants and degradable spacer particulates into a fracture within a subterranean formation, wherein the fracture has a lower portion and an upper portion;

b) introducing a spacer gel into the fracture;

c) repeating any sequence of a) and b) until a predetermined amount of the mixture of high-density slurry and low-density slurry and spacer gel has been introduced into the fracture;

d) allowing the high-density slurry to migrate to the lower portion of the fracture and form a high-density proppant pack; and e) allowing the low-density slurry to migrate to the upper portion of the fracture and form a high-density proppant pack, wherein a highly-conductive channel is formed in the fracture between the high-density proppant pack and the low-density proppant pack.

16. The method of claim 15, wherein the high-density proppants have a specific gravity greater than about 1.10 g/cm$^3$.

17. The method of claim 15, wherein the low-density proppants have a specific gravity less than about 0.95 g/cm$^3$.

18. The method of claim 15, wherein the high-density proppants and the low-density proppants are coated with a tackifying agent.

19. The method of claim 15, wherein the spacer gel is degradable.

20. The method of claim 15, wherein a), b), and c) are performed sequentially.

* * * * *